US005570953A

United States Patent [19]

DeWall

[11] Patent Number: 5,570,953

[45] Date of Patent: Nov. 5, 1996

[54] MUD-MIXING MACHINE FOR DRYWALL TEXTURING AND OTHER APPLICATIONS

[76] Inventor: Harlen E. DeWall, 26849 Caballero Canyon Rd., Escondido, Calif. 92026

[21] Appl. No.: 345,299

[22] Filed: Nov. 28, 1994

[51] Int. Cl.[6] ..... B28C 5/12; B28C 7/04

[52] U.S. Cl. ..... 366/10; 366/15; 366/38; 366/40; 366/51; 366/155.1; 366/157.1; 366/158.2; 366/182.4; 366/323

[58] Field of Search ..... 366/3, 5, 8, 10, 366/11, 13, 14, 15, 19, 20, 35, 38, 40, 50, 51, 60, 64, 66, 155.1–156.1, 157.1–157.2, 158.1, 158.2, 158.3, 158.4, 162.1, 181.1, 182.4, 186, 191, 250, 319, 322, 323, 325.3

[56] References Cited

U.S. PATENT DOCUMENTS

| | | | |
|---|---|---|---|
| 1,423,853 | 7/1922 | Hodgson | 366/13 |
| 1,611,297 | 12/1926 | Wickey | 366/35 |
| 1,954,005 | 4/1934 | Westberg et al. | 366/11 |
| 2,276,237 | 3/1942 | Lowry | 366/35 X |
| 2,942,860 | 6/1960 | Ridley et al. | 366/13 X |
| 3,006,615 | 10/1961 | Mason, Jr. | 366/20 |
| 4,117,547 | 9/1978 | Mathis et al. | 366/20 X |
| 4,298,288 | 11/1981 | Weisbrod | 366/11 X |
| 4,397,561 | 8/1983 | Strong et al. | 366/250 X |

FOREIGN PATENT DOCUMENTS

| | | | |
|---|---|---|---|
| 4119261 | 12/1992 | Germany | 366/35 |
| 4-64408 | 2/1992 | Japan | 366/20 |
| 1134723 | 1/1985 | U.S.S.R. | 366/10 |

*Primary Examiner*—Charles E. Cooley
*Attorney, Agent, or Firm*—Loyal McKinley Hanson

[57] ABSTRACT

A method of forming a mixture of powdered material and water includes the step of providing a hopper, a holding tank, a tube intermediate the hopper and the holding tank, and an air-powered auger arranged to feed powdered material from the hopper through the tube to the holding tank. The method proceeds by adding powdered material to the hopper, supplying water to the tube, and operating the auger to feed the powdered material into the tube, to mix it with water in the tube, and then to push the mixture out of the tube to the holding tank. For drywall texturing applications, the mixture may then be delivered from the holding tank under pressure to a spray nozzle. An apparatus for forming a mixture of powdered material and water includes a hopper, a holding tank, a tube intermediate the hopper and the holding tank, and an auger extending from the hopper into the tube. The auger feeds the powdered material from the hopper into the tube, mixes the powdered material in the tube with water introduced in the tube in order to produce the mixture, and then pushes the mixture out the second end of the tube to the holding tank. One embodiment includes a frame for supporting the foregoing components along with an air-driven motor for the auger, an air-driven pump for delivering the mud from the holding tank to a spray nozzle, a first air-driven stirring mechanism for stirring the powdered sack material in the hopper, a second air-driven stirring mechanism for stirring the mixture held in the holding tank, and suitable controls for regulating the production of mud according to the amount used.

14 Claims, 3 Drawing Sheets

MUD-MIXING MACHINE FOR DRYWALL TEXTURING AND OTHER APPLICATIONS

BACKGROUND OF THE INVENTION

1. Technical Field

This invention relates generally to building construction, and more particularly to a method and apparatus for mixing powdered sack material and water to produce mud for drywall texturing and other applications.

2. Description of Related Art

Recall that workmen texture drywall for various aesthetic, fireproofing, and acoustic reasons. First they mix powdered plaster, stucco, finish, EIFS, fireproofing, or other sack material with water to produce a viscous plaster-like mixture that is sometimes referred to as mud. Then, they spray the mud onto the drywall with high pressure nozzles. That gives the drywall the desired finish and characteristics.

However, existing methods and equipment for mixing the mud have certain drawbacks. Mud-mixing typically proceeds using a trailor-mounted mixing machine having a mixing tank in the 150–500 gallon range, a 15–50 horsepower gasoline engine, a 10–40 CFM air pump, and associated componentry. First, the user connects a line to a water outlet at the job site to fill the tank. After filling the tank, he adds sack material to the water while the gasoline engine operates to mix the combination, much like a portable cement-mixing machine. Once the mixture is thoroughly mixed, the user activates the air pump to spray the mud through a nozzle onto the drywall, and then he prepares a fresh batch of mud.

In addition to the cost of existing mixing equipment, one major problem is the time and attention it requires. Filling the water tank may alone take thirty minutes, and just the right amount of sack material must be added to produce a suitable mixture for spraying. Therefore, users need a better way to mix mud for drywall texturing and other applications.

SUMMARY OF THE INVENTION

This invention solves the problems outlined above by providing an inline mud-mixing method and apparatus. The apparatus (a mud mixing machine) includes a framework supporting a hopper, a mixing tube, an auger, a water reservoir, a mud holding tank, and associated components. The auger advances dry powdered sack material from the hopper through the mixing tube while water from the reservoir mixes with the sack material in the tube to produce mud at the downstream end. The mud collects in the holding tank from which it may be pumped to a spray nozzle as needed, and various controls regulate the mud production rate according to usage.

That arrangement eliminates the time required to fill a large water tank because inline auger feeding and mixing does not require a large tank of water. It also eliminates the time and attention required to periodically mix a large batch of mud in the tank of water because the user just adds sack material to the hopper when more is needed to continue the inline mixing process. Furthermore, the invention eliminates the need for a large motor or gasoline engine to drive a large mixing apparatus because inline auger feeding and mixing requires only a small air-driven motor. The user just connects the mud-mixing machine of this invention to a water line and an air line from a compressor at the job site, adds sack material to the hopper, adjusts the controls, and he is ready to spray in about five minutes.

To paraphrase the language subsequently presented in the claims, a method of forming a mixture of powdered sack material and water to produce mud for drywall texturing and other applications includes the step of providing a hopper, a tank, a robe intermediate the hopper and the tank, and an auger arranged to feed sack material from the hopper through the tube to the tank. The method proceeds by adding powdered material to the hopper, supplying water to the tube, and operating the auger to thereby cause the auger to feed the powdered material from the hopper into the tube with the auger, cause the auger to mix the powdered material and water in the robe in order to produce the mixture, and cause the auger to push the mixture out of the tube to the tank.

In line with the above, an apparatus for mixing mud includes a hopper for holding a supply of powdered material, a water inlet for receiving water, and a tank for receiving and holding a mixture of the powdered material and the water. The apparatus also includes a tube intermediate the hopper and the tank. The tube has a first end portion in communication with the hopper and the water inlet, a second end portion in communication with the tank, and a midportion intermediate the first and second end portions.

An auger is provided that extends from the hopper into the tube. The auger feeds the powdered material from the hopper into the tube. It also mixes the powdered material in the tube with water introduced in the tube from the water inlet in order to produce the mixture, and it pushes the mixture out the second end of the tube to the holding tank.

A preferred embodiment includes a frame for supporting the foregoing components along with an air-driven motor for the auger, an air-driven pump for delivering the mud from the holding tank to a spray nozzle, a first air-driven stirring mechanism for stirring the powdered sack material in the hopper, and a second air-driven stirring mechanism for stirring the mixture held in the holding tank. Suitable controls are included for regulating the production of mud according to the amount used. In addition, the auger may include a first flight having a first diameter for augering powdered material from the hopper into the first end of the tube, a second flight having a larger second diameter for augering the powdered material further into the tube, and a spiralled pattern of mixing paddles for mixing the powdered material and water to form the mixture and for pushing the mixture out of the second end of the tube. The following illustrative drawings and detailed description make the foregoing and other objects, features, and advantages of the invention more apparent.

DESCRIPTION OF A PREFERRED EMBODIMENT

Figure 1:
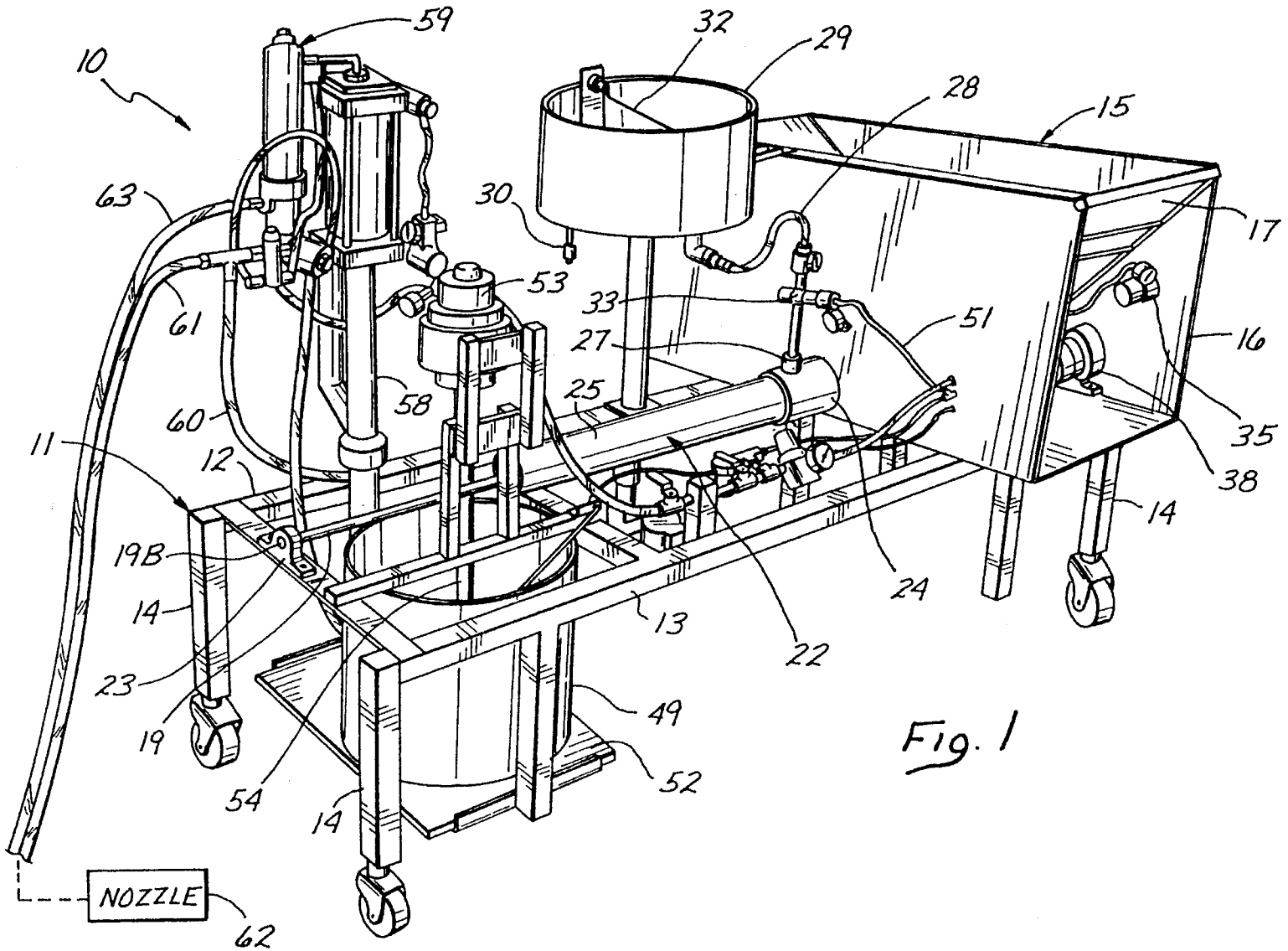
FIG. 1 of the drawings is a three-dimensional view of an apparatus or mud-mixing machine constructed according to the invention.

The drawings show an apparatus constructed according to the invention that is subsequently referred to as mud-mixing machine 10. Generally, the machine 10 includes a frame 11 that supports various air-driven components, controls, and lines. Any of various frames may be used, including the cart-like arrangement illustrated and even a trailor-like arrangement suitable for towing behind a truck.

As a general idea of size and construction, the illustrated frame 11 takes the form of a welded ladder-type frame having seven-foot long side rails 12 and 13 and fifteen-inch legs 14 formed of two-inch square steel tube. Two-foot long angle iron cross braces welded to the rails add rigidity and additional supporting structure for other components of the machine 10. The foregoing and subsequent description enable one of ordinary skill in the art to design and fabricate a suitable frame for that purpose.

The frame 11 supports a hopper 15 measuring about 2-feet high by 2-feet wide and 4-feet long. The hopper 15 serves to hold powdered sack material and it is bolted to cross braces of the frame 11. The hopper 15 is fabricated of 16 gauge galvanized sheet metal by bending a 4-foot by 6-foot sheet into a U-shaped component 16 and then riveting, welding, or otherwise suitably attaching a V-shaped piece 17 in the position illustrated in FIG. 1 to form a smooth 45-degree angle from top to bottom of the hopper 15. A 2⅛ inch hole 18 is cut through the U-shaped component 16 (FIG. 3) at a lower region of the of the V-shaped piece 17 for the one-inch shaft 19 of an auger 20 to pass through.

The shaft 19 of the auger 20 extends from a first end 19A (FIGS. 3–5) that is held by a first bearing 21 (FIGS. 3 and 5), through the hopper 15 (FIG. 2), through the hole 18 (FIG. 2), and through a 4-inch diameter tube 22 (FIGS. 1 and 2), to a second end 19B (FIGS. 1 and 4) that is held by a second bearing 23 on the frame 11 (FIG. 1). For that purpose, a hole is also cut in the U-shaped component 16 of the hopper 15 where the first bearing 21 is located, opposite the hole 18.

The tube 22 includes a first end portion 24 in communication with the interior of the hopper 15 through the hole 18 (FIGS. 1 and 3) so that rotation of the auger 19 will feed powdered sack material from the hopper 15 into the tube 22. For that purpose, the first end portion 24 of the tube 22 may take any of various suitable forms within the capabilities of one of ordinary skill in the art. The illustrated first end portion 24 includes a 4-inch by 4-inch by 1-inch plastic T-coupling of the type commercially available for use with plastic irrigation pipe. One 4-inch side connects by suitable means to the hopper 15 so that the first end portion 24 of the tube 22 is in communication with the hopper 15 through the hole 18.

One way to connect the T-coupling (i.e., the first end portion 24 of the tube 22) to the hopper 15, for example, is to first weld a 3-inch piece of 2-inch diameter pipe to a plate and bolt the plate on the exterior of the hopper 15 so that the 3-inch piece of pipe is inline with the hole 18. Next, glue or otherwise connect the 2-inch side of a plastic 4-inch to 2-inch reducer to the 3-inch piece of pipe, and then connect the T-coupling to the 4-inch side. Sliding the T-coupling onto the 4-inch side in a friction fit facilitates later removal for cleaning and repair. Those precise details of construction are not illustrated, and any of various other arrangements within the capabilities of one of ordinary skill in the art may be employed.

The other 4-inch side of the T-coupling connects to a 4-foot section of plastic irrigation pipe (e.g., with plastic pipe glue). The 4-foot section forms an intermediate portion 25 of the tube 22 (FIGS. 1 and 3) as well as a second end portion 26 (FIG. 3), and the second end portion is bolted, strapped, or otherwise suitably anchored to the frame 11. With the tube 22 so constructed, connected, and anchored, the auger 20 can be added or removed for repair purposes through second end portion 26 of the tube 22.

Figure 2:
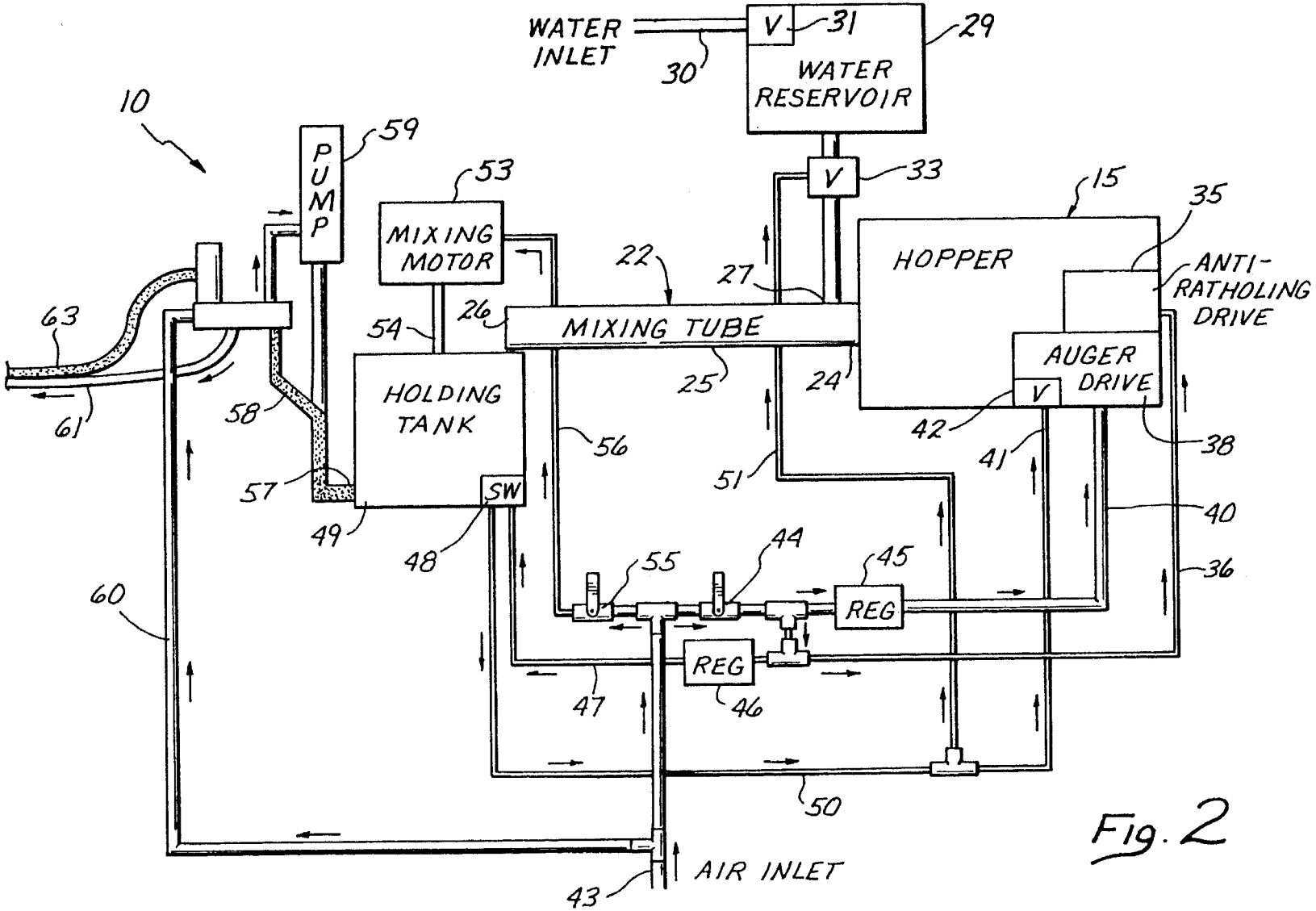
FIG. 2 is a schematic diagram of the machine.
Figure 3:
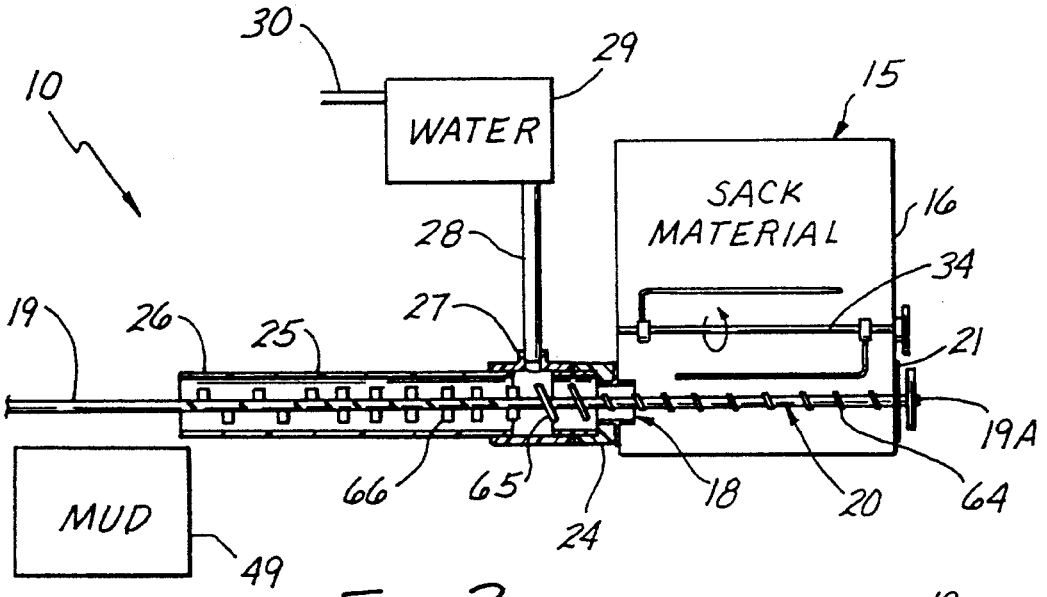
FIG. 3 is a simplified schematic diagram of the mixing method.

The 1-inch portion of the T-coupling (i.e., the first end portion 24 of the tube 22) provides an inlet 27 (FIGS. 1 and 3) for water to the tube 22. It connects via a line 28 to a water tank or reservoir 29, the illustrated reservoir 29 having a capacity of about five gallons. The reservoir 29 is suitably mounted on the frame 11 and it includes an inlet in the form of a standard water hose connection 30 (FIGS. 1–3). It may also include a water pressure regulator valve 31 (FIG. 2) fitted to a ball-float arrangement 32 (FIG. 1) on the top rim. An air-controlled valve 33 in the line 28 (FIGS. 1 and 2) controls water delivery from the reservoir 29 to the tube 22.

Figure 5:
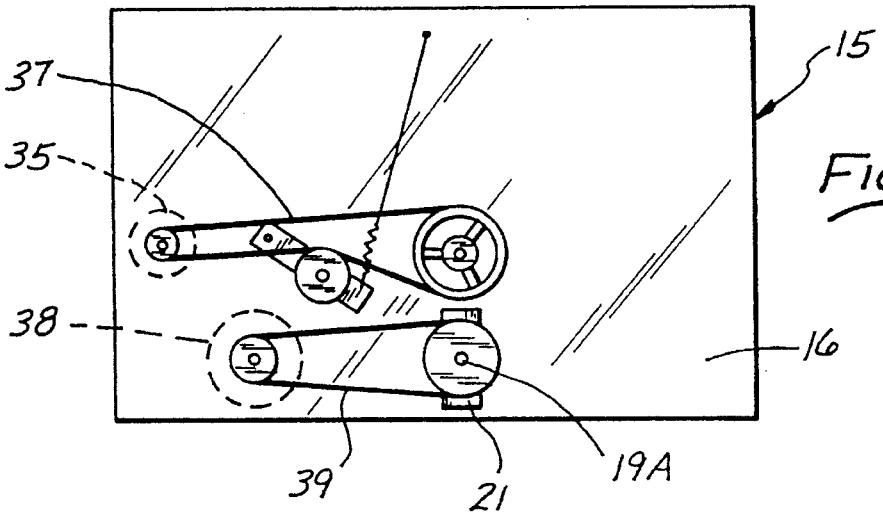
FIG. 5 is an enlarged view of a portion of the machine showing various drive components.

In operation, powdered material from the hopper 15 and water from the reservoir 29 mix within the tube 22 under action of the auger 20. As the auger 20 feeds the powdered material from the hopper 15, an air-powered first mixing mechanism 34 in the hopper 15 (FIG. 3) rotates to thereby agitate the powdered material and cause it to settle downwardly upon the auger 20. Sometimes referred to as an anti-ratholing device, the mixing mechanism 34 may include protruding arms on a shaft that is mourned within the hopper 5 about 6-inches above and parallel to the auger 20. It is driven by a commercially available air-powered drive motor 35 (FIGS. 1, 2, and 5) that is supplied pressurized air through a line 36 (FIG. 2). The motor 35 is coupled to the anti-ratholing device 34 by a first drive-belt-and-pulleys arrangement 37 (FIG. 5).

The auger 20 is also air-powered. It is driven by a commercially available air-powered motor 38 (FIGS. 1, 2, and 5) that is coupled to the first end portion 19A of the shaft 19 by a second drive-belt-and-pulleys arrangement 39 (FIG. 5). A line 40 supplies pressurized air to the motor 38, and a line 41 (FIG. 5) supplies pressurized air to an auger motor control switch 42 that operates to turn the auger drive motor 38 on and off.

Pressurized air from a conventional air compressor or other source (not shown) is coupled to an air inlet 43 (e.g., a conventional air hose fitting). The pressurized air passes from the air inlet 43 through a valve 44 and an air regulator 45 to the line 40, and from there to the motor 38. The air regulator 45 regulates air flow to achieve a desired rate of rotation of the auger 20 for proper mixing. Water flow from the reservoir 29 is also adjusted to a suitable rate for proper mixing.

The pressurized air also passes from the air valve 44 to the line 37 and the motor 35. In addition, the pressurized air passes from the air valve 44 through an air regulator 46 to a line 47 and a float controlled On/Off level switch 48 on a mixed-material holding tank 49 (MMHT) as depicted in FIG. 2. The air regulator 46 regulates air flow to achieve desired switch action. From the On/Off level switch 48, the pressurized air passes through a line 50 to the line 41 (connected to the auger motor control valve 42) and to a line 51 (connected to the valve 33 between the reservoir 29 and the inlet 27 on the tube 22).

The holding tank 49 takes the form of an upwardly opening 25-gallon steel tank (FIGS. 1 and 3) that sets atop a 24-inch by 20-inch piece of ¾-inch plywood 52 (FIG. 1 ). A suitable angle iron support structure welded on the frame 11 secures the plywood 52 on the frame 11. A cleanout drain (not shown) may be provided at the bottom of the tank.

A mixture of powdered material and water passing out of the second end portion 26 of the tube 22 (sometimes referred to as the "mixture" or "mud") drops into and collects in the holding tank 49. When the level of mud in the tank 49 reaches a preset level (e.g., one inch from the top of the tank), the level switch 48 (FIG. 2) actuates to turn off the auger drive motor 38 and the water valve 33 between the reservoir 29 and the inlet 27 of the tube 22.

As mud accumulates in the holding tank 49, a commercially available air-powered motor 53 drives a second stirring mechanism 54 (FIGS. 1 and 2) to stir the mud in the tank 49. That helps maintain a desired mud consistency. Pressurized air from the air inlet 43 (FIG. 2) passes through an air valve 55 and a line 56 to power the motor 53. As the user sprays, accumulated mud passes through an outlet 57 in the tank 49 (FIG. 2) and through a line 58 to a commercially available air-powered pump 59 (FIGS. 1 and 2). The pump 59 uses known componentry (including, for example, an air motor powered stator tube) that one of ordinary skill in the art can implement without further descriptive details.

Pressurized air from the air inlet 43 (FIG. 2) passes through a line 60 to the pump 59 and to a hose 61 (FIGS. 1 and 2) that supplies air to a known type of spray gun nozzle 62 (FIG. 1) that the user operates to spray the mud. The pump 59 operates in a known manner to pump the mud from the tank 49 through a hose 63 to the nozzle 62.

Figure 4:
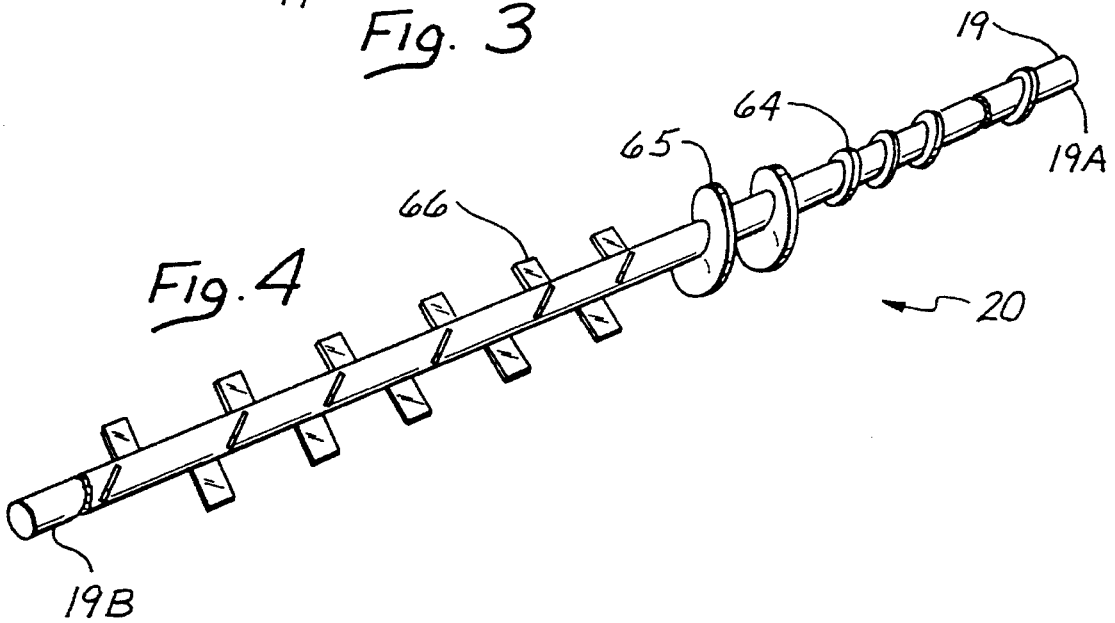
FIG. 4 is an enlarged three-dimensional view of the auger.

As the mud is used, the apparatus 10 of this invention automatically mixes more under action of the auger 20 in the tube 22. In that connection, the shaft 19 of the auger 20 includes a 2-inch diameter first auger flight 64 (FIGS. 3 and 4). The first auger flight 64 extends through the hole 18 into the first end portion 24 of the tube 22, and it feeds the powdered material from the hopper 15 through the hole 18 into the first end portion 24. The auger 20 also includes a 4-inch diameter second auger flight 65 that extends about 8-inches. It advances the powdered material within the tube 22 to the point where water is introduced into the tube (i.e., at the location of the water inlet 27). Thereafter, the auger 20 includes mixing paddles 66. They are attached to the shaft 19 in a spiralled pattern and they are angled to push the mixture out of the second end portion 26 of the tube 22. The last 12-inches or so of the shaft 19 are left bare so that the mud can dump into the holding tank 49.

Recapitulating, the user connects a water hose from a jobsite spigot to the water inlet 30 of the apparatus 10 to fill the reservoir 29, and he connects an air compressor to the air inlet 43. Next, he loads about 10-gallons of dry powdered sack material (e.g., spray texture material) into the hopper 15, and opens the mixing control valve 44.

With the holding tank 49 empty, air supplied to the air valve level control switch 48 flows to the air valve 33, the air valve 42, and the anti-ratholing drive motor 35. Then, the auger 20 operates to feed powdered material into the mixing tube 22 while water flows through the valve 33 into the tube. Mixing continues until the level switch 48 actuates.

Operating the valve 55 activates the second stirring mechanism 54. The valve 31 of the water reservoir 29 keeps the reservoir full. Mud consistency can be controlled with the regulator 45 by varying the speed of the auger 20—greater auger speed makes thicker mud because the water flow is constant.

As mud is pumped to the nozzle by the pump 59, the level in the tank 49 drops until the air valve level control switch 48 turns on. Then mixing resumes. When no more mud is needed, the user closes the mixing control valve 44 so that the mud remaining in the holding tank 49 can be used up. The anti-ratholing first stirring mechanism 34 agitates material in the hopper 15 so it can be fed to the mixing tube 22. If needed, the hopper is periodically refilled with dry powdered sack material.

Thus, the invention provides an air-powered, inline mud-mixing method and apparatus. It eliminates the time required to fill a large water tank because inline auger feeding and mixing does not require a large tank of water. It eliminates the time and attention required to periodically mix a large batch of mud in the tank of water because the user just adds sack material to the hopper when more is needed to continue the inline mixing process. It eliminates the need for a large motor or gasoline engine to drive a large mixing apparatus because inline auger feeding and mixing requires only a small air-driven motor. The user just connects the mud-mixing machine of this invention to a water line and an air line at the job site, adds sack material to the hopper, adjusts the controls, and he is ready to spray.

Although an exemplary embodiment has been shown and described, one of ordinary skill in the art may make many changes, modifications, and substitutions without necessarily departing from the spirit and scope of the invention. Many of the illustrated components (i.e., the regulators, air-powered motors, air valves, timing gears and belts, bearings, air switch, and control valves) are commercially available components sold under the trademarks CAST and GROVER. Electric or gasoline motors can be used instead of the air-driven motors described without departing from the broader aspects of the invention.

What is claimed is:

1. An apparatus for forming a mixture of powdered material and water, comprising:

means in the form of a hopper for holding a supply of powdered material;

means in the form of a tank for receiving and holding a mixture of the powdered material and water;

a tube intermediate the hopper and the tank, the tube having a first end portion in communication with the hopper, a second end portion in communication with the tank, and a midportion intermediate the first and second end portions;

a water inlet in communication with the tube; and means in the form of an auger extending from the hopper into the tube for feeding the powdered material from the hopper into the tube, for mixing the powdered material in the tube with water introduced in the tube through the water inlet in order to produce the mixture, and for pushing the mixture out the second end of the tube to the holding tank;

wherein the auger includes a first flight having a first diameter for augering powdered material from the hopper into the first end of the tube, a second flight having a larger second diameter for augering the powdered material further into the tube, and a spiralled pattern of mixing paddles for mixing the powdered material and water to form the mixture and for pushing the mixture out of the second end of the tube.

2. An apparatus as recited in claim 1, further comprising means in the form of a support structure for supporting the apparatus.

3. An apparatus as recited in claim 1, further comprising means in the form of a reservoir coupled to the water inlet for holding a supply of the water to be introduced in the tube through the water inlet.

4. An apparatus as recited in claim 1, further comprising means in the form of an air-driven pump for pumping the mixture from the tank to a spray nozzle.

5. An apparatus as recited in claim 1, further comprising an air-driven motor for driving the auger.

6. An apparatus as recited in claim 1, further comprising means in the form of a first air-driven stirring apparatus for stirring the powdered material in the hopper.

7. An apparatus as recited in claim 1, further comprising means in the form of a second air-driven stirring apparatus for stirring the mixture in the tank.

8. An air-driven apparatus for forming a mixture of powdered material and water, comprising:

means in the form of an air inlet for receiving pressurized air for use in driving the apparatus;

means in the form of a water inlet for receiving water;

means in the form of a hopper for receiving and holding powdered material to be mixed with the water; and means in the form of a tank for receiving and holding a mixture of the powdered material and the water;

the apparatus including a tube in communication with the water inlet, the tube having a first end portion in communication with the hopper, a second end portion in communication with the holding tank, and a mid-portion intermediate the first and second end portions; and the apparatus also including means in the form of an air-powered auger extending from the hopper into the tube for feeding the powdered material from the hopper into the tube, for mixing powdered material in the tube with water introduced in the tube in order to produce the mixture, and for pushing the mixture out the second end of the tube to the tank;

wherein the auger includes a first flight with a first diameter for augering powdered material from the hopper into the first end of the tube, a second flight with a larger second diameter for augering the powdered material further into the tube, and a spiralled pattern of mixing paddles for both mixing the powdered material and water to form the mixture and for pushing the mixture out of the second end of the tube.

9. An apparatus as recited in claim 8, further comprising means in the form of a support structure for supporting the apparatus.

10. An apparatus as recited in claim 8, further comprising means in the form of an air-driven pump for pumping the mixture from the tank to a spray nozzle.

11. An apparatus as recited in claim 8, further comprising means in the form of a first air-driven stirring apparatus for stirring the powdered material in the hopper and means in the form of a second air-driven stirring apparatus for stirring the mixture in the tank.

12. An apparatus as recited in claim 8, further comprising means in the form of an air-controlled valve for controlling the flow of water into the tube.

13. An apparatus as recited in claim 8, further comprising means in the form of an air-controlled regulator for regulating operation of the auger.

14. An apparatus as recited in claim 8, further comprising means in the form of a control arrangement for controlling production of the mixture so that the mixture does not overflow the tank.

* * * * *